US009193638B1

(12) United States Patent
Groven et al.

(10) Patent No.: US 9,193,638 B1
(45) Date of Patent: Nov. 24, 2015

(54) CONDENSED PHASE ENERGETIC TIME DELAY COMPOSITIONS

(71) Applicants: Lori J. Groven, Clarks Hill, IN (US); Eric J. Miklaszewski, Lafayette, IN (US); Jay C. Poret, Sparta, NJ (US); Anthony P. Shaw, Madison, NJ (US)

(72) Inventors: Lori J. Groven, Clarks Hill, IN (US); Eric J. Miklaszewski, Lafayette, IN (US); Jay C. Poret, Sparta, NJ (US); Anthony P. Shaw, Madison, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 117 days.

(21) Appl. No.: 13/911,314

(22) Filed: Jun. 6, 2013

(51) Int. Cl.
*C06B 33/00* (2006.01)
*D03D 23/00* (2006.01)
*D03D 43/00* (2006.01)

(52) U.S. Cl.
CPC ..... *C06B 33/00* (2013.01)

(58) Field of Classification Search
USPC ..... 149/37, 108.2, 108.6, 109.4, 109.6
See application file for complete search history.

(56) References Cited

U.S. PATENT DOCUMENTS 6,881,284 B2 * 4/2005 Makowiecki et al. ..... 149/109.6
8,381,652 B2 * 2/2013 Glenn ..... 102/306

OTHER PUBLICATIONS

Miklaszewski, Eric J., et al, Ti/C-3Ni/Al as a Replacement Time Delay Composition, Propellants, Explosives, Pyrotechnics, 2014, 138-147, 39.

* cited by examiner

*Primary Examiner* — James McDonough
(74) *Attorney, Agent, or Firm* — Henry S. Goldfine

(57) ABSTRACT

An environmentally safe, nontoxic energetic time delay composition useful in small diameter aluminum tubes (i.e., typical military delay housings), which provides desired delay propagation rates of from less than about 2 to about 38 mm/s through such delay housings—the compositions being compressed stoichiometric mixes of Ti and C powders; Ni and Al powders; a combination of Ti/C and 3Ni/Al powders; and a combination of Ti/C and Ni/Al powders, diluted with inert alumina.

6 Claims, 2 Drawing Sheets

CONDENSED PHASE ENERGETIC TIME DELAY COMPOSITIONS

FEDERAL RESEARCH STATEMENT

The inventions described herein may be manufactured, used and licensed by, or for, the U.S. Government, for U.S. Government purposes.

BACKGROUND OF INVENTION

1. Field of the Invention

The present invention relates to energetic time delay compositions that are useful in military flares, signals, grenades, and various munitions which require a delay between initiation and detonation/ignition; which compositions are environmentally benign and nontoxic, and which repeatably exhibit the desired delay times/burning rates.

2. Background Art

In general terms, energetic materials produce a self-sustained exothermic chemical reaction upon ignition. Pyrotechnic compositions are widely used for a variety of military and civilian applications including explosive and fragmentation munitions, igniters, flares, smoke/gas generators and fireworks. Typically, pyrotechnics are composed of a fuel or combination thereof (e.g., aluminum, tungsten, silicon, boron, and magnesium) that is mixed with an oxidizer or combination thereof (e.g., perchlorates, chlorates, nitrates, and metal oxides)—which ingredients readily react in exothermic, reduction-oxidation (redox) type reactions to produce the desired pyrotechnic effects. These compositions can be tailored to meet various application requirements, such as burning rate, by changing a variety of control parameters including particle size/morphology, stoichiometry, degree of confinement and consolidation density to name a few. For example, some energetic reactants such as nano-thermites can have a burning rate as high as 1000 m/s (meters per second), while pyrotechnic delay compositions can have burning rates as low as 0.6 mm/s (millimeters per second).

Slow-burning delay compositions are uniformly required to produce a repeatable time interval between energetic stages or elements. Such materials are commonly used in delay fuzes that are widely used by the military in flares, signaling devices, grenades, mortars, and artillery projectiles. Having a reliable timed delay in such devices is critical, to provide a safe time interval after the user initiates the device and before the ignition of the device's primary charge, e.g., to provide the desired flare, signal, smoke, or the detonation/fragmentation—such as of a grenade. The delay interval is a function of the time that it takes the slow-burning delay composition to propagate a set distance. Typically, slow-burning delay compositions are housed in aluminum, zinc alloy, or lead tubes, contained within the flares, signals, and grenades or similar devices. The delay composition is ignited by an electrical or chemical igniter and after the slow-burning composition completes its propagation, along the length of its container, it in-turn ignites an output charge, which in-turn ignites the main charge of the device, i.e., the flare, signal, smoke, or detonation component. Further, considering the heat loss resulting from the metal tube enclosures used for such devices, the energetic delay composition must maintain an adequate reaction temperature to avoid being quenched and extinguished by the heat loss to and through the housing itself.

Many of today's pyrotechnic time delay compositions contain environmentally hazardous and toxic materials including heavy metals, chromates, and perchiorates (e.g., $BaCrO_4$, $PbCrO_4$, and $KClO_4$). Even while these materials are facing increasing regulatory scrutiny, they are still in widespread use in military delay systems, due to their proven reliability and their ability to provide a wide range of combustion velocities, i.e., delays. Commonly used compositions include the tungsten delay ($W/BaCrO_4/KClO_4$/diatomaceous earth), the manganese delay ($Mn/BaCrO_4/PbCrO_4$), the zirconium-nickel delay (Zr—Ni alloy/$BaCrO_4/KClO_4$), and the T-10 delay ($B/BaCrO_4$). One of the most versatile of these pyrotechnic delays is the $W/BaCrO_4/KClO_4$/diatomaceous earth system (the tungsten delay), that may be tuned to give combustion velocities ranging from 0.6-150 mm/s. This system has proven viable in the small diameter tube housings typically used for military applications—housings where heat losses can be substantial due to the high thermal conductivity of the metal housing (often die-cast zinc alloy or aluminum), and where the housing may have an internal diameter as small as 5 mm. Due to such high heat loss environments, finding alterative energetic materials that do not fail due to combustion front instabilities (e.g., oscillations, pulsations), or simply due to extinction, has proven challenging. Further, the current $W/BaCrO_4/KClO_4$/diatomaceous earth compositions are also "gasless" (producing less than 10 ml of gas per gram of composition) allowing them to be used in sealed/semi-sealed housings with a reduced risk of premature case rupture. Finding an alternative which functions and propagates slowly in a high heat loss environment, while also not producing any significant amount of gas, has proven challenging.

Therefore, there is a need in the art for an environmentally benign and sustainable (i.e., safe) replacement for the current environmentally hazardous and toxic commonly used pyrotechnic delay compositions (e.g. $W/BaCrO_4/KClO_4$/diatomaceous earth, $Mn/BaCrO_4/PbCrO_4$, Zr—Ni alloy/$BaCrO_4/KClO_4$, and $B/BaCrO_4$)—a replacement that will repeatably and fully propagate the entire length of the narrow, metal, tube delay housings typically used in military applications and that will burn without generating any significant gas by-products. Further, any replacement should be "tunable" to burn faster or slower—so as to provide a range of desired delay times.

SUMMARY OF INVENTION

In order to provide a functional, alternative energetic delay composition that overcomes the above stated problems of the prior art—the present inventive energetic delay is composed of embodiments of compressed mixtures of (1) a stoichiometric mix of 80 wt. % Ti and 20 wt. % C powders alone (Ti/C); or, (2) a stoichiometric mix of 68.5 wt. % Ni and 31.5 wt. % Al powders alone (Ni/Al); or, (3) a combination of about 35 to about 40 wt. % of the stoichiometric Ti/C powder mixture with about 65 wt. % to about 60 wt. % of a stoichiometric mix 86.7 wt. % of Ni and 13.3 wt. % of Al powders (Ti/C-3Ni/Al); or, (4) a combination of 14.7 wt. % of the stoichiometric Ti and C powder mix (Ti/C), with 83.3 wt. % of the stoichiometric Ni and Al powder mix (Ni/Al), which is diluted with 2 wt. % of an inert diluent, such as preferably $Al_2O_3$ (alumina) powder (Ti/C—Ni/Al—$Al_2O_3$). These inventive mixtures, when initiated: (i) can be tailored or tuned to provide desired reaction rates of from under about 2 mm/s to about 38 mm/s when compressed in thick-walled aluminum tubes with small internal diameters of from about 3 to 6 mm (typical of military delay tube housings); (ii) react in the condensed phase, i.e., such that the reactions can be classified as "gasless"; and (iii) react in such an exothermic manner as to generate and maintain a reaction temperature of over 1800 degrees K, to propagate the full length of the delay housing without being quenched (extinguished) by the heat transfer there through. Further, in the present invention, the rate of propagation has proven to be a function of the degree to which the inventive mixtures are compressed, i.e., the mass of the materials per unit volume (which is typically expressed as % of theoretical maximum density, i.e., % TMD). And, the particular compressed densities found to be useful in the present invention are from about 37 to about 60% TMD.

The fastest propagating energetic time delay embodiment of the present invention is a composition composed of a simple mixture at the stoichiometric ratio, Le, 80 wt % to 20 wt. %, of Ti and C powders (Ti/C), respectively—which when consolidated (i.e., compressed) to about a 50% TMD, in typical military delay tube housings—exhibited a relatively fast propagation velocity of about 38 mm/s. A second fast-propagating energetic time delay embodiment of the present invention is a composition composed of a simple mixture of Ni and Al powders (Ni/Al), in a stoichiometric ratio, i.e., 68.5 wt. % Ni and 31.5 wt. % Al—which exhibits a relatively fast propagating velocity of about 24 mm/s, when consolidated to about 50% TMD in typical military delay tube housings.

A slower propagating energetic time delay embodiment of the present invention is a composition composed of a mixture of about 35 wt. % of the stoichiometric Ti/C powder mixture, with about 65 wt. % of a stoichiometric 3Ni/Al mixture—which exhibits a propagation rate of from about 2.1 to 3.7 mm/s, at about 37 to about 60% TMD in typical military delay tube housings.

A still slower propagating energetic time delay embodiment of the present invention is a composition of about 14.7 wt. % of the stoichiometric Ti and C powder mixture, mixed with about 83.3 wt. % of a stoichiometric Ni/Al mixture, and mixed with about 2 wt. % of alumina ($Al_2O_3$) powder—which exhibits a propagation rate of as low as about 1.6 mm/s, at about 48% TMD, in typical military delay tube housings.

Additionally, in order to repeatably obtain the desired propagation rates of the above detailed mixtures, it is critical that in the case of more than a 2 component mixture, that the mixtures be formulated in a precise order. So, for example, in the case of the mixture of 35 wt. % of the stoichiometric Ti and C powder mixture with 65 wt. % of a stoichiometric 3Ni and Al mixture, the titanium and carbon powders are first mixed together and the nickel and aluminum powders are separately mixed together and the two binary mixtures subsequently mixed together. This is due to the fact that the Carbon particles tend to coat the other particles upon mixing and having the Ti and C together and the 3Ni and Al together is critical to reliably and repeatedly obtain the desired 2 to about 5 mm/s propagation rate from this particular embodiment (note: as stated above, the 2 to 5 mm/s range being dependent upon the % TMD of the mixture).

Finally, features and advantages of the present invention will be set forth in, or are apparent from, the detailed description of preferred embodiments thereof which follows.

DETAILED DESCRIPTION OF THE PREFERRED EMBODIMENTS

Figure 1:
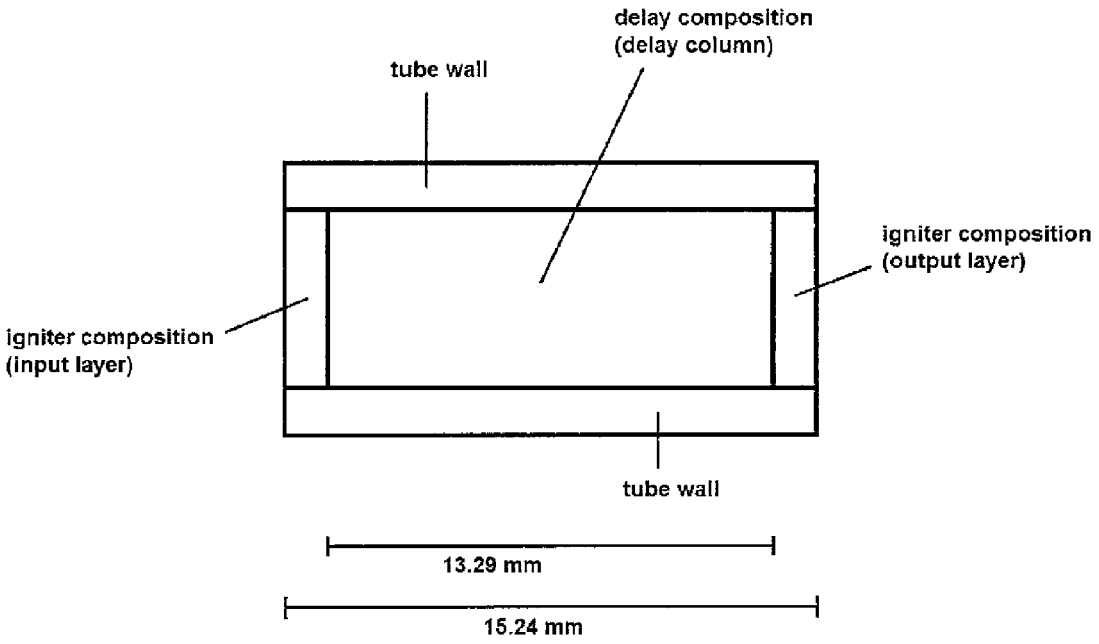
FIG. 1 is a cross-sectional layout of a typical energetic time delay tube—containing an igniter composition layer on the left side thereof—which ignites the subject inventive delay mixture in the middle, and an igniter composition on the right side thereof—which ignites the flare, or signal, or smoke, or grenade charge, or whatever material is contained within the overall device to achieve the desired function of the device.

The present inventive energetic time delay composition is composed of compressed mixtures of (1) a stoichiometric mix of 80 wt. % Ti and 20 wt. % C powders alone (Ti/C); or, (2) a stoichiometric mix of 68.5 wt. % Ni and 31.5 wt. % Al powders alone (Ni/Al); or, (3) a combination of about 35 to about 40 wt. % of the stoichiometric Ti/C powder mix with about 65 wt. % to about 60 wt. % of a stoichiometric 86.7 wt. % of Ni and 13.3 wt. % of Al powders (Ti/C-3Ni/Al); or, (4) a combination of 14.7 wt. % of the stoichiometric Ti and C powder mix (Ti/C), with 83.3 wt. % of the stoichiometric Ni and Al powder mix (Ni/Al), which is diluted with 2 wt. % of an inert diluent, such as preferably $Al_2O_3$ powder (Ti/C—Ni/Al—$Al_2O_3$). These particular embodiments of the present invention: (i) can be tuned to: provide reaction rates of from under about 2 mm/s to about 38 mm/s, when compressed in thick-walled aluminum tubes with small internal diameters of from about 3 to 6 mm (typical of military delay housings); (ii) involve condensed phase reactions (such that the reactions can be classified as "gasless" (i.e. producing less than 10 ml/g of gas); and (iii) involve reactions so exothermic that a reaction temperature of over 1800K can be maintained throughout the propagation of the reaction along the entire length of the tube housing—i.e. such that the reaction propagates the entire tube length without being quenched/extinguished. In the present invention, the rate of propagation has proven to be a function of the degree to which the inventive mixtures are compressed, the mass of the materials per unit volume (which is typically expressed as % of theoretical maximum density, i.e., % TMD). And, the particular consolidated densities found to be useful in the present invention are from about 40 to about 60% TMD.

As stated above, it has been shown that the fastest propagating embodiment of the present energetic time delay invention is composed of a simple stoichiometric mixture of 80 wt. % Ti powder and 20 wt. % C powder—which exhibits a relatively fast propagation velocity of about 38 mm/s in typical military delay tube housings (when compressed or consolidated to a % TMD of about 50). A second relatively fast propagating embodiment of the present pyrotechnic delay invention is composed of a simple mixture of Ni and Al powders, in a stoichiometric ratio of 68.5 wt. % Ni and 31.5 wt. % Al—which exhibits a propagation rate of about 24 mm/s, when consolidated to about 50% TMD in typical military delay tube housings.

As further and generally discussed above, a slower propagating energetic time delay embodiment of the present invention is a composition composed of a mixture of about 35 to about 40 wt. % of the stoichiometric Ti/C powder mixture, with about 65 to about 60 wt. % of a stoichiometric 3Ni/Al powder mixture—which exhibits a propagation rate of about 2 mm/s, at about a 40% TMD to about a 57% TMD, in typical military delay tube housings. And, the slowest propagating energetic time delay embodiment of the present invention is a composition of about 14.7 wt. % of the stoichiometric Ti and C powder mixture, mixed with about 83.3 wt. % of a stoichiometric Ni/Al mixture, and mixed with about 2 wt. % of an inert ingredient, preferably alumina ($Al_2O_3$) powder—which exhibits propagation rates of as low as about 1.6 mm/s, at about 48% TMD, to as high as about 2.7 mm/s, at about 54% TMD, in typical military delay tube housings.

In an alternative preferred embodiment of the present invention, a 0.25 mm insulating graphite foil (available from Graftech International, Lakewood, Ohio 44107, under the tradename of Grafoil®) can be inserted as a heat transfer barrier between the compressed inventive energetic time delay compositions (the reactant mixture) and the delay housing tube—as a thermal barrier or liner. This barrier will reduce the loss of heat from the reaction and helps to allow the reaction to propagate the full length of the housing tube—without being quenched by heat transfer to and through the tube walls. Therefore, smaller diameter housing tubes can be used with the subject thermal barrier without reaction quenching and this also results in somewhat faster propagation rates as more heat is transferred through the reactive mixtures instead of to the tube walls (see Table 3 below). In fact, the use of such thermal barriers is functionally equivalent to the use of a larger internal tube diameter. In both cases (i.e., use of an insulating graphite foil or use of a larger diameter tube), more heat (as a percentage of the total composition reaction heat) is available to be transferred through the reactive mixture, and correspondingly less is transferred to the tube walls.

The particular reactants useful in the embodiments of the present invention—i.e., Ti, C, Ni, Al, and $Al_2O_3$ powders are available from the sources shown in Table 1, below. Further, the preferred particle size/mesh of each reactant is also shown in Table 1, below.

TABLE 1

Reactants useful in the present invention.

| Reactant Powder | Source | Nominal Particle Size |
|---|---|---|
| Al | Atlantic Equipment Engineers (AEE), Upper Saddle River, NJ 07458 | 1-5 μm |
| C (lamp black) | Spectrum Chemical, New Brunswick, NJ 08901 | Sub-μm |
| Ni | Alfa Aesar, a Johnson Matthey Company, Ward Hill, MA 01835 | 3-11 μm |
| Ti | Alfa Aesar, a Johnson Matthey Company, Ward Hill, MA 01835 | −325 mesh |
| $Al_2O_3$ | Novacentrix, Austin, TX 78728 | 40 nm |

Preferably, the reactants useful in the present invention (the reactants detailed in Table 1, above) are dry mixtures of the fine powdered component reactants discussed above. As stated above, the subject reactant powders (i.e., Carbon in the present invention) tends to coat the other reactants—such that the order of mixing is important—the individual reactants (i.e., Ti, C, Ni, and Al) being mixed to form the binary components (e.g., Ti/C and Ni/Al and 3Ni/Al) and then, if needed, the binary components being mixed to form the overall mixtures (e.g., Ti/C-3Ni/Al or Ti/C—Ni/Al—$Al_2O_3$). So, for example, the Ti/C-3Ni/Al embodiment composition was made by first preparing separate Ti/C and 3Ni/Al mixtures which were then combined and mixed to give the completed Ti/C-3Ni/Al composition. And, the Ti/C—Ni/Al—$Al_2O_3$ embodiment composition was made by first preparing separate Ti/C and Ni/Al mixtures which were then combined with $Al_2O_3$ and mixed to give the completed Ti/C—Ni/Al—$Al_2O_3$ composition.

In the various examples presented below, particularly preferred delay tubes for use with the current energetic time delay composition are cylindrical aluminum (Al) (grade 2024-T3) tubes with various inner and outer diameters—typical for delay tubes used in military signals and munitions. While all of the tubes were 15.24 mm long—those with an inner diameter (ID) of 4 mm had an outer diameter (OD) of 8.94 mm; those with a 4.8 mm ID had an OD of 9.32 mm; and those with an ID of 6 mm had an OD of 10 mm. And, as stated above, in some cases, a 0.25 mm insulating graphite foil liner was inserted into the tubes. Where, for example, when this graphite foil liner was inserted into the 4.8 mm ID tubes, the effective ID was reduced to 4.3 mm. Further, an igniter composition consisting of a mixture of 65 wt. % finely powdered (−325 mesh) Zr, 25 wt. % finely powdered (−325 mesh) $Fe_2O_3$, and 10 wt. % finely powdered diatomaceous earth was used at both ends of each delay tube, surrounding the delay composition within the tube, typical of the configuration used in military delay tubes. Further, each delay tube was prepared by the successive addition and packing of igniter composition, delay composition, and igniter composition, in that order. A cross-section of a completed delay tube (without graphite foil liner) is shown in FIG. 1. Within each delay tube, the igniter composition layers occupied approximately 1.95 mm of length and the delay composition occupied approximately 13.29 mm of length. Within the tube, this 13.29 mm length of delay composition is also referred to as the "delay column".

Example 1

Figure 2:
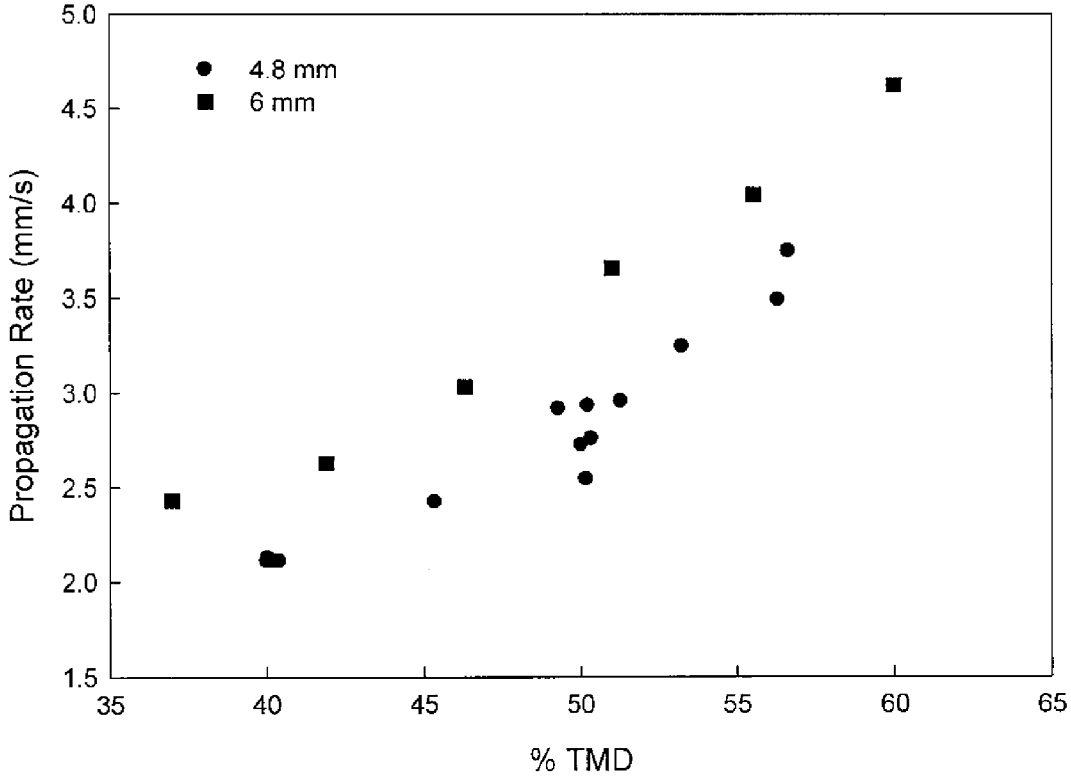
FIG. 2 is a graph of the propagation rate in mm/s vs. % TMD for the Ti/C-3Ni/Al embodiment of the present invention, in typical aluminum military delay tube housings, with typical 4.8 mm and 6 mm internal diameters, as shown and described in Example 1 and corresponding Table 2.

A first series of experiments were conducted using the Ti/C-3Ni/Al powder mix embodiment of the present invention—the results of which are shown in Table 2, below. As apparent from Table 2, this embodiment is relatively robust, as demonstrated by its repeatability and consistency within the operable range of % TMD. In this operable range (about 40 to about 57% TMD in 4.8 mm ID Al tubes, and about 37 to about 60% TMD in 6 mm ID Al tubes) no failures or partial propagations were observed and the trends in reaction rate are consistent. The propagation rate, in mm/s, at the various % TMD is shown for this Ti/C-3Ni/Al embodiment in FIG. 2.

TABLE 2

Propagation distances and rates with % TMD for the Ti/C—3Ni/Al system (35 wt. %-65 wt. %) in 4.8 mm (top data set) and 6 mm (bottom data set) ID Al tubes.

| % TMD | Reaction Rate (mm/s) | Propagation Distance (mm) |
|---|---|---|
| 38.26 | — | 4.76 |
| 39.97 | — | 5.06 |
| 40.02 | 2.11 | 13.29 |
| 40.04 | 2.13 | 13.29 |
| 40.24 | 2.11 | 13.29 |
| 40.41 | 2.11 | 13.29 |
| 45.36 | 2.42 | 13.29 |
| 49.32 | 2.91 | 13.29 |
| 50.04 | 2.72 | 13.29 |
| 50.20 | 2.54 | 13.29 |
| 50.25 | 2.93 | 13.29 |
| 50.36 | 2.76 | 13.29 |
| 51.31 | 2.95 | 13.29 |
| 53.26 | 3.24 | 13.29 |
| 56.31 | 3.49 | 13.29 |
| 56.63 | 3.74 | 13.29 |
| 59.51 | — | 3.57 |
| 59.77 | — | 4.29 |
| 60.00 | — | 4.02 |
| 60.32 | — | 3.43 |
| 60.56 | — | 4.09 |
| 37.00 | 2.43 | 13.29 |
| 41.89 | 2.63 | 13.29 |
| 46.32 | 3.03 | 13.29 |

TABLE 2-continued

Propagation distances and rates with % TMD for the Ti/C—3Ni/Al system (35 wt. %-65 wt. %) in 4.8 mm (top data set) and 6 mm (bottom data set) ID Al tubes.

| % TMD | Reaction Rate (mm/s) | Propagation Distance (mm) |
|---|---|---|
| 51.01 | 3.65 | 13.29 |
| 55.53 | 4.04 | 13.29 |
| 59.98 | 4.62 | 13.29 |
| 64.50 | — | 4.01 |

Note: the % TMD values for which no rate data is shown are cases where the particular composition, at the particular % TMD, failed to propagate the full 13.29 mm length of the delay column - i.e., indicating that the particular formulation/configuration is not useful/functional in applications of the present invention.

Example 2

A second series of experiments were conducted using the Ti/C—Ni/Al—$Al_2O_3$ mixture embodiment of the present invention using 4.8 mm ID Al tubes, this system was found to be operable in the about 47.87 to about 53.72% TMD range (see Table 3, below). The use of a graphite foil liner allows the system to operate in a larger, about 46.88 to about 61.81% TMD range.

TABLE 3

Propagation distances and rates as a function of % TMD for the Ti/C—Ni/Al—$Al_2O_3$ system (14.7 wt. %-83.3 wt. %-2 wt. %) in 4.8 mm inner diameter aluminum tubes with and without 0.25 mm graphite foil liner.

| % TMD | Reaction Rate (mm/s) | Propagation Distance (mm) |
|---|---|---|
| | 4.8 mm inner diameter Al tube: | |
| 44.29 | — | 6.31 |
| 44.54 | — | 6.28 |
| 45.45 | — | 6.40 |
| 47.87 | 1.59 | 13.29 |
| 49.12 | 1.78 | 13.29 |
| 50.63 | 2.49 | 13.29 |
| 50.72 | 1.95 | 13.29 |
| 51.40 | 2.76 | 13.29 |
| 52.49 | 2.45 | 13.29 |
| 53.07 | 2.43 | 13.29 |
| 53.72 | 2.71 | 13.29 |
| 55.78 | — | 6.28 |
| | 4.8 mm ID Al tube with 0.25 mm graphite foil liner: | |
| 41.73 | — | 6.66 |
| 45.62 | — | 7.76 |
| 46.88 | 2.30 | 13.29 |
| 48.55 | 2.42 | 13.29 |
| 51.72 | 2.99 | 13.29 |
| 58.53 | 4.96 | 13.29 |
| 61.81 | 6.10 | 13.29 |
| 65.30 | — | 3.29 |
| 65.51 | — | 2.00 |
| 70.75 | — | 2.99 |

Note: the % TMD values for which no rate data is shown are cases where the particular composition, at the particular % TMD, failed to propagate the full 13.29 mm length of the delay column - i.e., indicating that the particular formulation/configuration is not useful/functional in applications of the present invention.

Although the invention has been described above in relation to preferred embodiments thereof, it will be understood by those skilled in the art that variations and modifications can be effected in these preferred embodiments without departing from the scope and spirit of the invention.

What is claimed is:

1. An energetic time delay fuse composition useful in typical military delay tube housings, which composition comprising, a mixture of about 35 to about 40 wt. % of a stoichiometric mix of Ti and C, with about 65 wt. % to 60 wt. % of a stoichiometric mix of 3Ni and Al wherein said compressed mixture of powders reacts at a propagation rate of from less than about 2 mm/s to about 38 mm/s;

wherein said compressed mixture of powders reacts in a condensed phase generating less than 10 ml/g of gas;

wherein said compressed mixture of powders reacts in an exothermic manner at a reaction temperature of over 1800 K; and whereby said reaction propagates the entire length of the delay tube housing.

2. An energetic time delay composition useful in typical military delay tube housings, which composition comprising a mixture of 14.7 wt. % of the stoichiometric Ti and C mix, with 83.3 wt. % of the stoichiometric Ni and Al mix, and 2 wt. % $Al_2O_3$ powder wherein said compressed mixture of powders reacts at a propagation rate of from less than about 2 mm/s to about 38 mm/s;

wherein said compressed mixture of powders reacts in a condensed phase generating less than 10 ml/g of gas;

wherein said compressed mixture of powders reacts in an exothermic manner at a reaction temperature of over 1800 K; and whereby said reaction propagates the entire length of the delay tube housing.

3. The energetic time delay fuse composition of claim 1, wherein the mixture is compressed to about 37 to about 60% TMD.

4. The energetic time delay fuse composition of claim 1, wherein:

the Al powder has a particle size of 1 to 5 μm;

the C powder has a sub-μm particle size;

the Ni powder has a particle size of 3 to 11 μm;

the Ti powder has a particle size which is −325 mesh;

the $Al_2O_3$ has a particle size of 40 nm.

5. A method of manufacture of an energetic time delay composition useful in typical military delay tube housings, which method comprising:

mixing a stoichiometric quantity of Ti powder with a stoichiometric quantity of C powder to form a Ti/C powder mixture;

mixing a stoichiometric quantity of Ni powder with a stoichiometric quantity of Al powder to form a 3Ni/Al powder mixture;

mixing about 35 to 40 wt. % of the Ti/C powder mixture with about 65 wt. % to 60 wt. % of the 3Ni/Al powder mixture to form a Ti/C-3Ni/Al powder mixture; and compressing said Ti/C-3Ni/Al powder mixture to about a 37 to about 60% TMD.

6. A method of manufacture of an energetic time delay composition useful in typical military delay tube housings, which method comprising:

mixing a stoichiometric quantity of Ti powder with a stoichiometric quantity of C powder to form a Ti/C mixture;

mixing a stoichiometric quantity of Ni powder with a stoichiometric quantity of Al powder to form an Ni/Al mixture;

mixing 14.7 wt. % of the Ti/C mixture with 83.3 wt. % of the Ni/Al mixture and with 2 wt. % of $Al_2O_3$ powder to form a Ti/C—Ni/Al—$Al_2O_3$ powder mixture; and compressing the Ti/C—Ni/Al—$Al_2O_3$ powder mixture to from about 48 to about 54% TMD.

* * * * *